US008183485B2

(12) United States Patent
Ahn

(10) Patent No.: US 8,183,485 B2
(45) Date of Patent: May 22, 2012

(54) CIRCUIT BREAKER HAVING AUTOMATIC RELEASE LINKAGE

(75) Inventor: Kil Young Ahn, Daejeon (KR)

(73) Assignee: LS Industrial Systems Co., Ltd., Anyang-si, Gyeonggi-do (KR)

( * ) Notice: Subject to any disclaimer, the term of this patent is extended or adjusted under 35 U.S.C. 154(b) by 932 days.

(21) Appl. No.: 12/195,001

(22) Filed: Aug. 20, 2008

(65) Prior Publication Data

US 2009/0050460 A1 Feb. 26, 2009

(30) Foreign Application Priority Data

Aug. 20, 2007 (KR) ..... 10-2007-0083352

(51) Int. Cl.
*H01H 5/00* (2006.01)

(52) U.S. Cl. ..... 200/400; 218/154

(58) Field of Classification Search ..... 200/400
See application file for complete search history.

(56) References Cited

U.S. PATENT DOCUMENTS 5,731,560 A * 3/1998 Nebon et al. ..... 218/22
7,956,307 B2 * 6/2011 Ahn ..... 218/154

FOREIGN PATENT DOCUMENTS

JP 61-224227 10/1986
JP 9-288960 11/1997

* cited by examiner

*Primary Examiner* — R S Luebke
*Assistant Examiner* — Lheiren Mae Caroc
(74) *Attorney, Agent, or Firm* — Lee, Hong, Degerman, Kang & Waimey

(57) ABSTRACT

A circuit breaker having an automatic release linkage is disclosed that is capable of preventing damage and deformation of elements by automatic linkage release before electro-impulsive force generated from within the circuit breaker by a large short-circuit current causes the damage and deformation of open/close linkage.

5 Claims, 9 Drawing Sheets

CIRCUIT BREAKER HAVING AUTOMATIC RELEASE LINKAGE

CROSS-REFERENCE TO RELATED APPLICATIONS

This application claims the benefit of earlier filing date and right of priority to Korean Application No. 10-2007-0083352, filed on Aug. 20, 2007.

TECHNICAL FIELD

The following description relates generally to a circuit breaker, and more particularly to a circuit breaker having an automatic release linkage capable of preventing damage and deformation of elements by automatic linkage release before electro-impulsive force generated from within the circuit breaker by a large short-circuit current causes the damage and deformation of open/close linkage.

BACKGROUND ART

Generally, a circuit breaker is an electric protecting apparatus installed between an electric source and load units for protection of load units such as a motor and a transformer and an electric line from an abnormal current (a large current caused by i.e., short circuit and ground fault) generated at an electric circuit such as a power transmission/distribution line and private power transforming facilities. In other words, a circuit breaker is an automatic electrical switch that stops or restricts the flow of electric current in a sudden overloaded or otherwise abnormally stressed electrical circuit. A circuit breaker provides automatic current interruption to a monitored circuit when undesired over-current conditions occur. The over-current condition includes, for example, arc faults, overloads, ground faults, and short-circuits.

In order to break the line, the air circuit breaker is equipped with a stationary contactor and a movable contactor at a breaking mechanism where a current is made to flow in normal situation by connecting the stationary contactor and the movable contactor, and when there occurs a flaw at any portion of the line to allow flowing a large current, the movable contactor is instantly separated from the stationary contactor to open the circuit, thereby interrupting the flow of the large current.

A normal load current flows at a connected (service) position where the movable contactor and the stationary contactor are completely connected, where the circuit breaker is designed in such a manner as to sustain an impact force caused by short-circuit current for a predetermined time against the short-circuit current according to load capacity of the circuit breaker. The short-circuit current sustainable by the circuit breaker is detected by a trip relay and an actuator to trip an operating mechanism.

FIG. 1 is a schematic configuration of a typical circuit breaker in which a trip spring is compressed to allow a contact point to be turned off, FIG. 2 is a schematic configuration of a typical circuit breaker in which a trip spring is elongated to allow a contact point to be turned off, and FIG. 3 is a schematic configuration in which an over-current is applied to turn off the contact point in the exemplary implementation of FIG. 2.

Referring to FIGS. 1 to 3, the circuit breaker may include a movable conduction unit (3) rotatably coupled to any one terminal out of upper and lower terminals (1, 2), where a movable contact point is fixedly formed at a position in opposition to a stationary contact point mounted at the other terminal out of the upper and lower terminal (1, 2), and an operation mechanism (10) rotating the movable conduction unit (3) to allow the movable contact point to be connected to (ON) or be separated (OFF) from the stationary contact point.

Under the connected (ON) state, an open lever (23) and an open latch (22) are mutually connected to maintain an ON state in which the movable conduction unit (3) and the stationary contact point are contacted, and when a large current caused by flawed conditions (including, but are not limited to, current overload, ground faults, over voltage conditions and arcing faults) is detected, a trip solenoid (19) may rotate the open lever (23) to release the latched (meshed or contacted) condition between the open lever (23) and the open latch (22), thereby performing the OFF operation of separating the movable contact unit (3) from the upper terminal (1).

To be more specific, FIG. 1 refers to an OFF state of the contact point at the movable conduction unit (3) of the circuit breaker, in which an open/close axis (14) of the operation mechanism (10) is rotated to be brought into contact with an open/close axis stopper (18). A connection spring (56) is compressed by a rotating driver lever (16) due to rotation of a cam (12) caused by a motor or a manual handle (not shown), as illustrated in FIG. 1. The cam (12) in which the connection spring (56) is compressed may maintain equilibrium by an ON lever (20) contacting a connection latch (13). An ON coupling (17) contacting a connection button (25) or a connection solenoid (not shown) may be in a position that can rotate the ON lever (20).

When the ON coupling (17) moves down to rotate the ON lever (20), the connection latch (13) releases the cam (12), and force of the connection spring (56) is transmitted to a toggle link (15) through the driver lever (16), whereby the open/close axis (14) is rotated clockwise to expand an open spring (57) as illustrated in FIG. 2. The movable conduction unit (3) may contact the stationary contact point of the upper terminal (1) in response to the clockwise rotation of the open/close axis to conduct the lower terminal (2) and the upper terminal (2). Concurrently, a compression spring (58) is also compressed in order to allow the circuit breaker to have a resistance for a short period of time (capacity of conducting a short-circuited current for a second). The compression spring (58) applies a force toward the opening of the movable conduction unit (3).

As illustrated in FIG. 2, the equilibrium of the circuit breaker under the connected condition is maintained with the open latch (22) being latched to the open lever (23) through the toggle link (15) and a connection link (28). At this time, the OFF operation is such that, when the open lever (23) is rotated by an open button (26), an OFF plate or the trip solenoid (19), the open latch (22) is rotated to release the toggle link (15) toggled under the connected condition and to allow the open/close axis (14) to be counterclockwise rotated by the open spring (57) and the compression spring (58), causing the contact points to be in the OFF state as shown in FIG. 3. The cam (12) may be rotated again in order to compress the connection spring (56), as shown in FIG. 1.

If an over-current flows while the circuit breaker is in the connected condition, as shown in FIG. 2, an electro-impulsive (impact) force is generated by a current between the movable conduction unit (3) and the stationary contact point of the upper terminal (1) in response to the electro-dynamic compensation effect. The impact force may be transmitted to constitutional elements (parts) in various operational mechanisms (10) such as the toggle link (15), the connection link (28) and the open latch (22) via a transmission link (4).

Although the circuit breaker can withstand the impact force within the scope of the resistance for a short period of time with the assistance of the compression force of the compression spring (58) and the toggle link (15), but if a short-circuited current greater than normal flows in the movable conduction unit (3), a large impact force is transmitted to the operational mechanisms via the transmission link (4) to deform or do damage to the toggle link (15) before a trip relay (not shown) and the trip solenoid (19) release the open lever (23).

TECHNICAL PROBLEM

The present invention is provided in view of the above problems, and the above discussed and other drawbacks and deficiencies of the prior art are overcome or alleviated by a circuit breaker having automatic release linkage capable of preventing damage and deformation of elements by automatic linkage release before an electron-impact force generated from within the circuit breaker by a large short-circuited current causes the damage and deformation of an open/close linkage.

The foregoing and other objects, features, aspects and advantages of the present invention will become more apparent from the following detailed description of the present invention and exemplary implementations when taken in conjunction with the accompanying drawings.

TECHNICAL SOLUTION

A circuit breaker having an automatic release linkage for accomplishing the aforementioned objects including a movable conduction unit (3) for selectively conducting a first terminal (2) and a second terminal (1) by contacting the second terminal (1) while being electrically connected to the first terminal (2), and an open/close linkage including a connection linkage (140) for transmitting an impact force from the movable conduction unit (3) to a trip roller (55) as an operational force, the circuit breaker comprises: an open lever (190); a first link (150) rotatably fixing the trip roller (55), rotatably formed about a latch pin (150*a*) and having a size that does not interfere with an open lever (180) during rotation; a second link (160) rotatably coupled at the first link (150) so that a lateral cross-sectional surface thereof can contact the open lever (180); and a spring (170) so interposed between the first link (150) and the second link (160) that the first link (150) can be discretely applied with an elastic spring force from the open lever (180), wherein an operational moment (77*m*) trying to rotate the first link (150) by an operational force (77) reacts in a direction opposite to that of an elastic spring moment (Ms) trying to rotate the first link (150), such that, when an absolute value of the operational moment (77*m*) is greater than an absolute value of the spring moment (Ms), a lateral cross-sectional surface of the second link (160) connected to the open lever (180) slip on the open lever (180) to rotate the second link (160) relative to the first link (150), thereby releasing a contacted state between the open lever (180) and the second link (160).

Implementations of this aspect may include one or more of the following features. A lateral cross-sectional surface of the second link (160) connected to the open lever (180) may be formed with an upwardly inflected surface (99) facing the open lever (180).

A rotating center of the second link (160) may be located between a latch pin (150*a*) and the open lever (180).

The other cross-sectional surface of the second link (160) may be connected to the latch pin (150*a*) in order to prevent one side of the second link (160) from rotating toward a direction trying to get near to the open lever (180), while a lateral cross-sectional surface of the second link (160) contacts the open lever (180).

The first link (150) may be fixedly disposed therein with a spring seat (171), a pair of second links (160) may be disposed inside the first link (150) to allow a surface facing the spring seat (171) to be formed with a spring accommodation unit (160*b*), and the spring (170) may be interposed between the spring seat (171) and the spring accommodation unit (160*b*) of the second link (160).

ADVANTAGEOUS EFFECTS

The circuit breaker having an automatic release linkage is operated in such a fashion that, if an impulsive force from a movable conduction unit reacts greatly by one surface of a second link being closely connected to an open lever and rotatably coupled to a first link, an operational moment in response to an operational force acting from a connection link relative to a trip roller rotatably mounted at the first link is made to act opposite to a spring moment of a spring, whereby a contact state between one surface of the second link and the open lever is slidably released to remove the rotational restraint of the first link, and the restraint between an open/close linkage and the trip roller is automatically released at the same time, effectively preventing the damage to constitutional elements such as an open/close axis of the open/close linkage, a toggle link and a connection link.

BEST MODE

Figure 1:
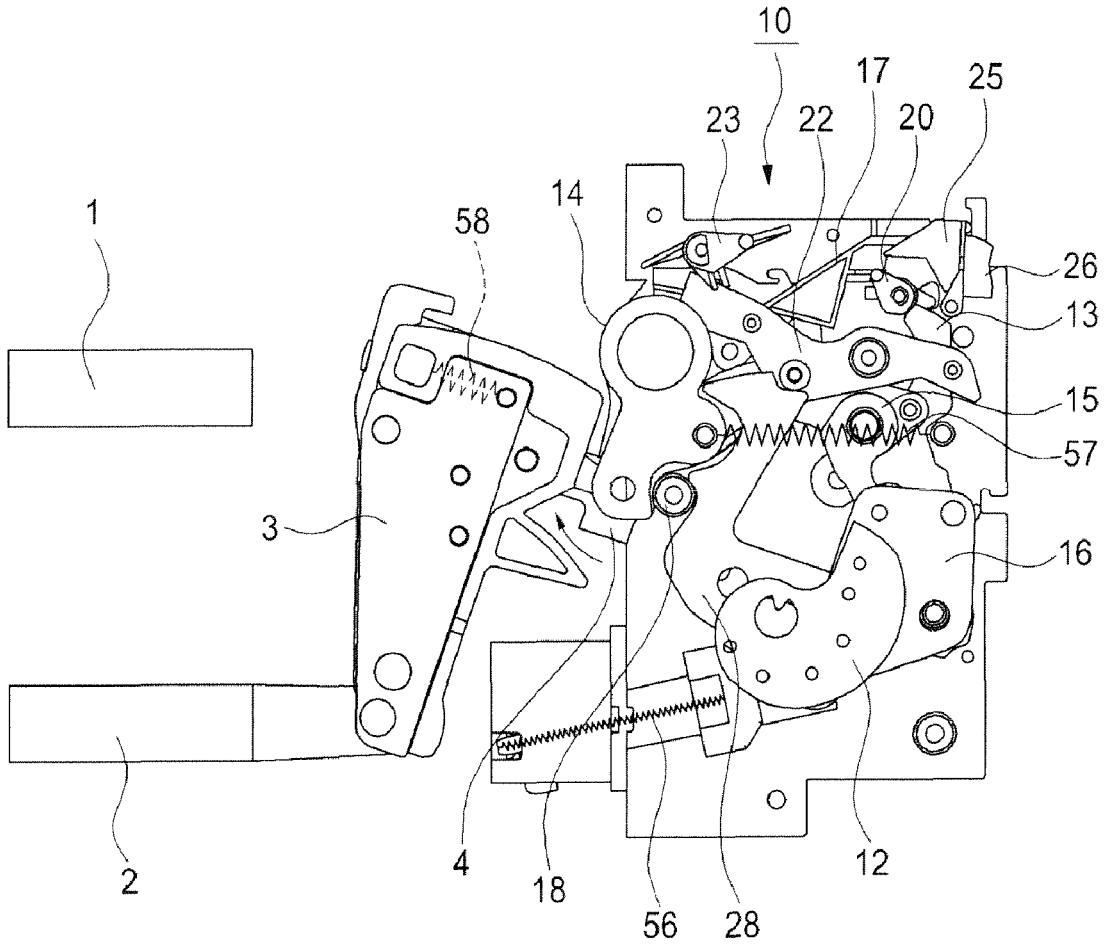
FIG. 1 is a configurative drawing of a circuit breaker in which a connection spring is compressed to turn off a contact point.
Figure 2:
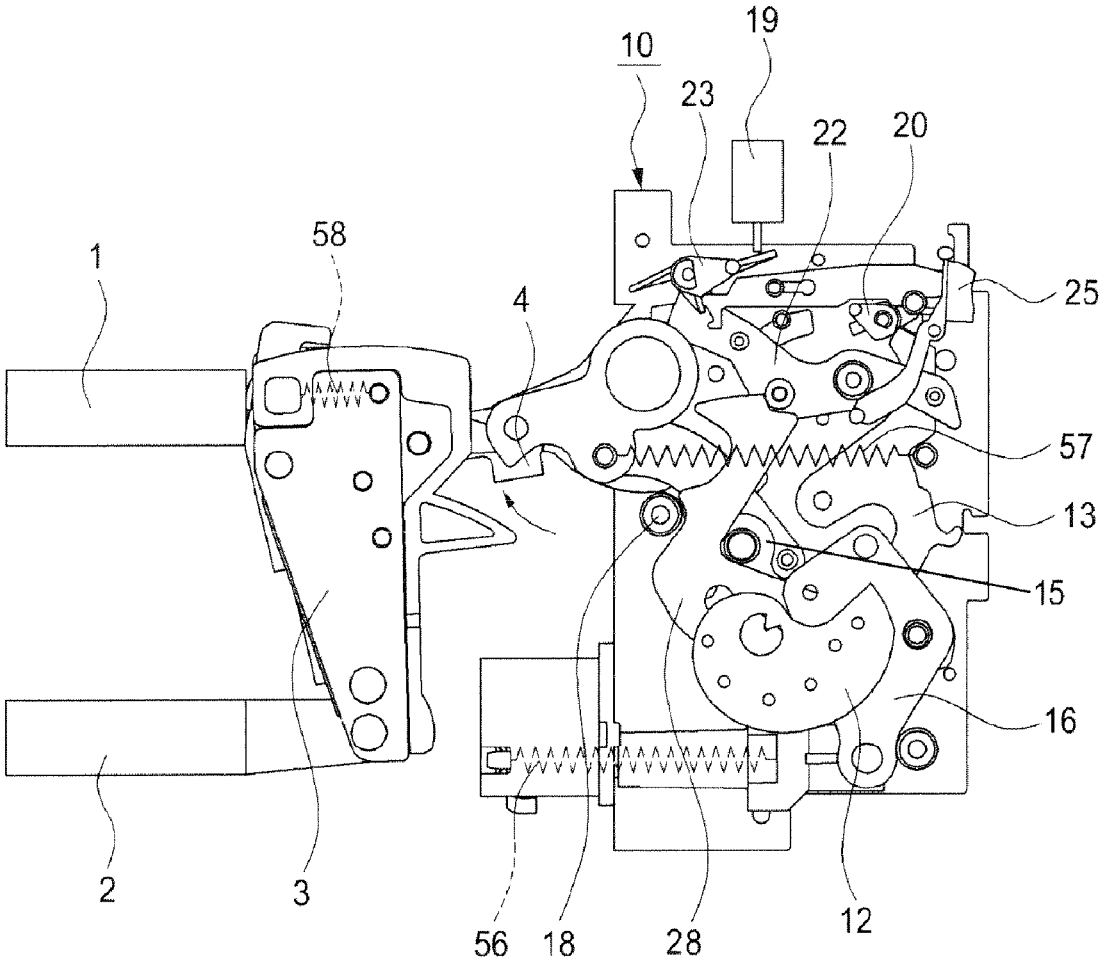
FIG. 2 is a configurative drawing of a circuit breaker in which a connection spring is expanded to turn on a contact point.

Exemplary implementations of a circuit breaker having an automatic release linkage according to the present novel concept will be described in detail with reference to the accompanying drawings, preferably FIGS. 1 to 3. Detailed description with regard to known art or construction will be omitted for clarity of the invention.

Figure 4:
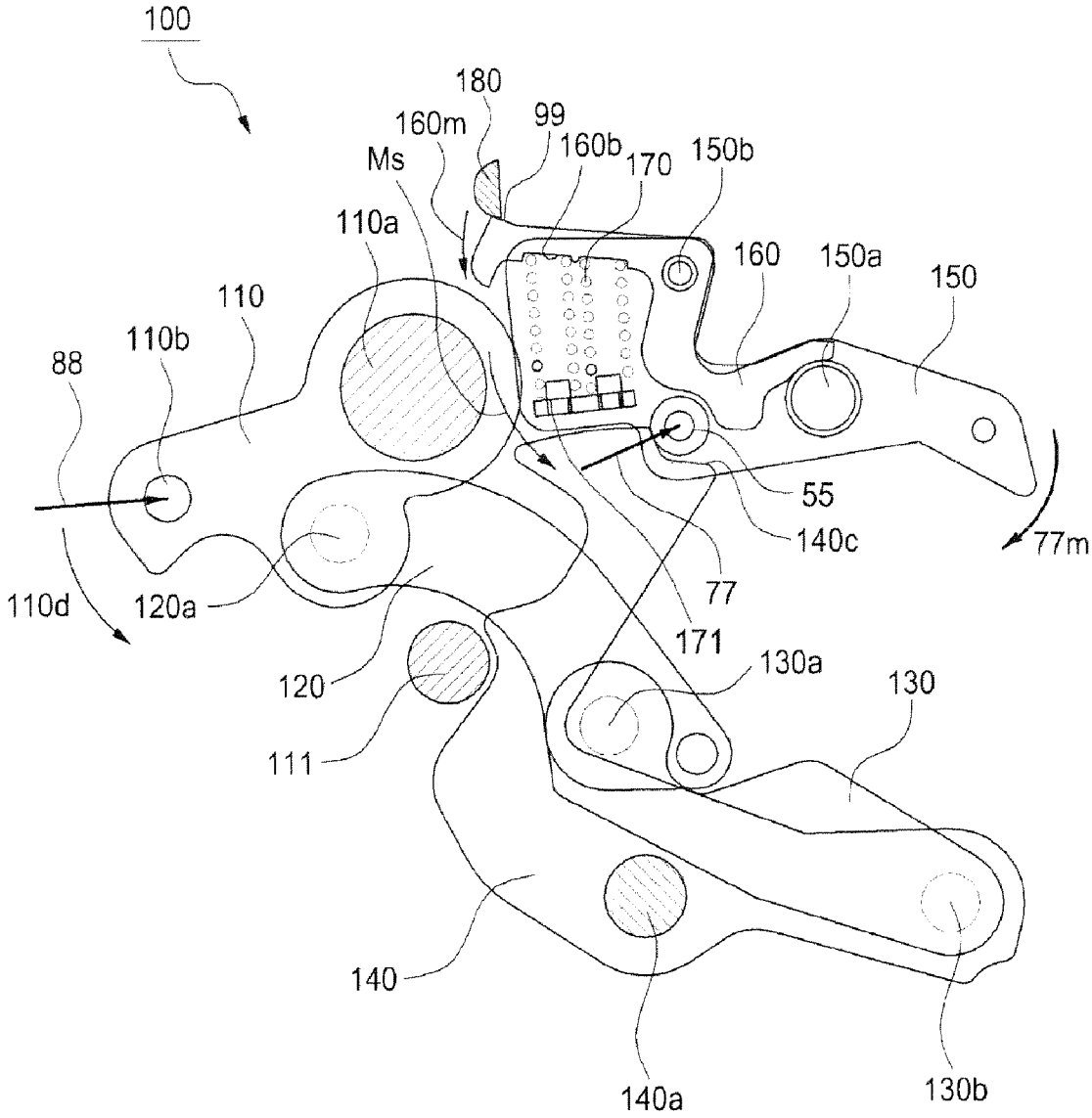
FIG. 4 is a configurative drawing of principal elements in which a connection state of an open/close linkage and an automatic release linkage in the circuit breaker is shown according to an exemplary implementation.
Figure 5:
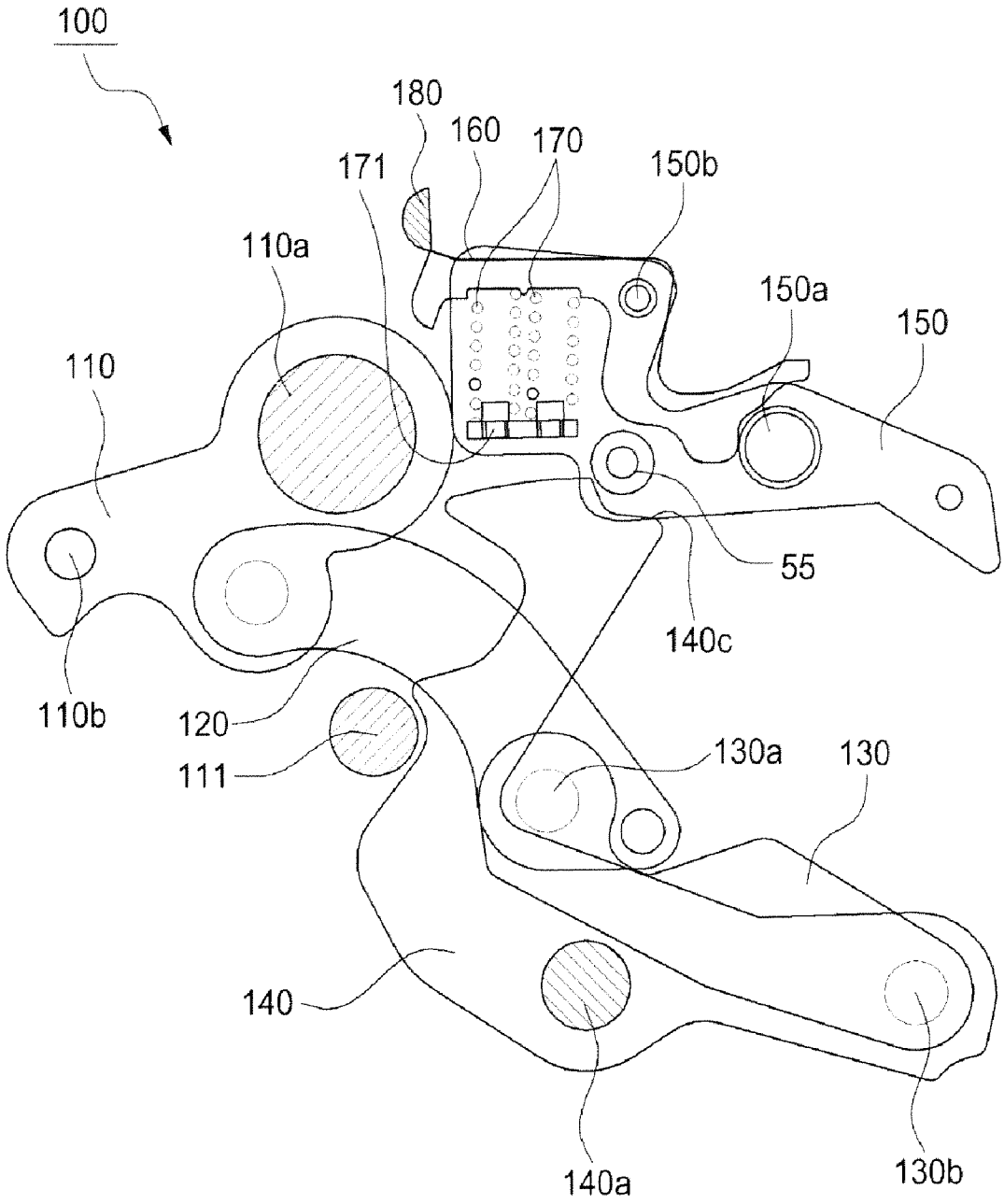
FIG. 5 is a configurative drawing of automatic release operational state according to the exemplary implementation of FIG. 4.
Figure 6:
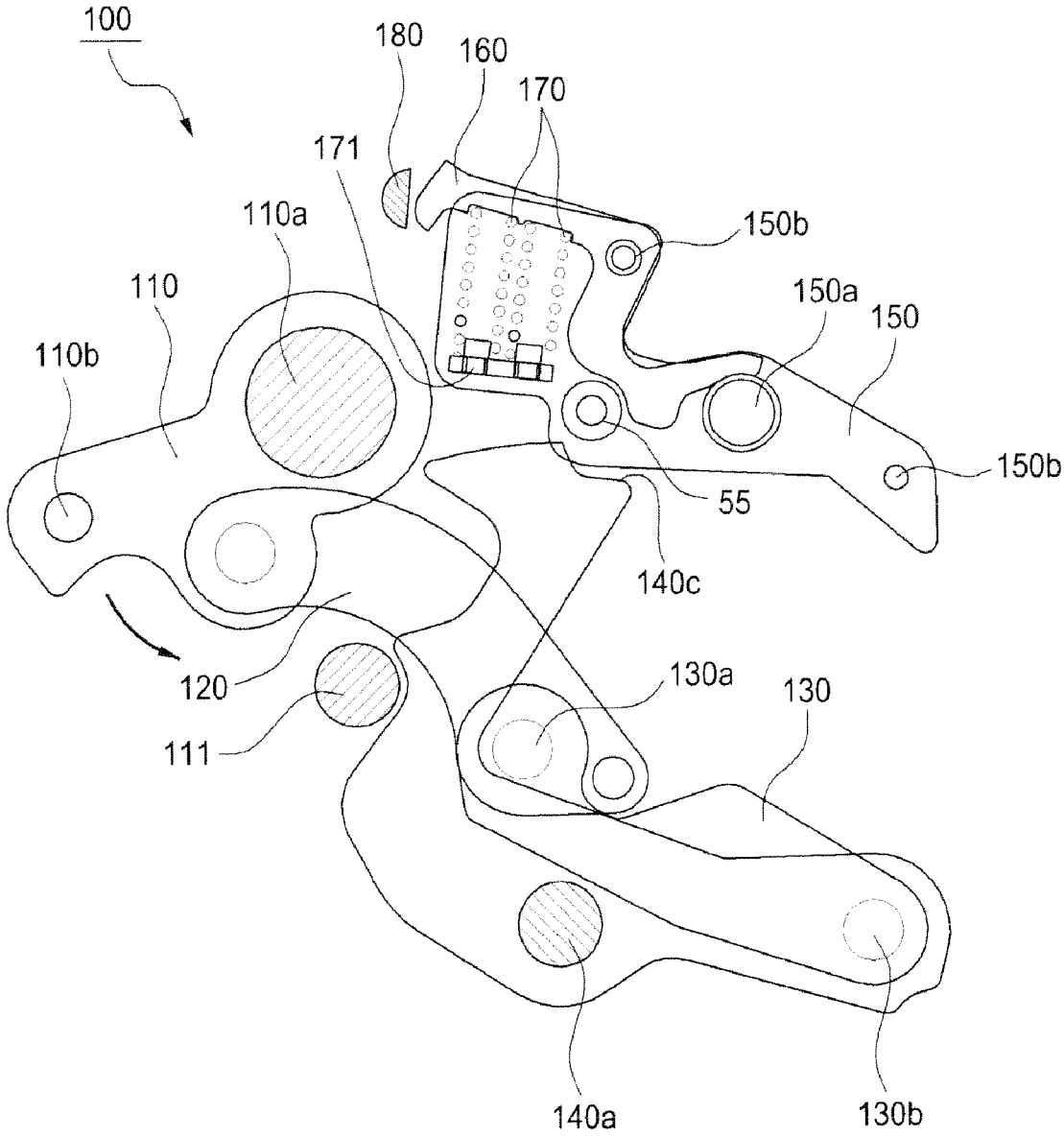
FIG. 6 is a configurative drawing of an automatic release operational state having been completed according to the exemplary implementation of FIG. 4.
Figure 7:
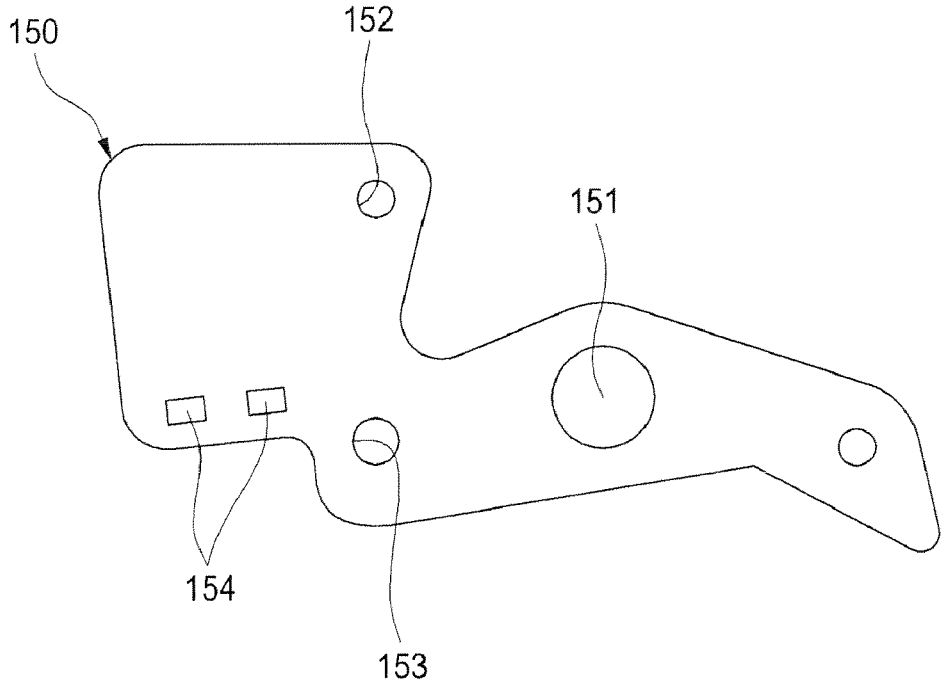
FIG. 7 is a lateral view of a first link according to the exemplary implementation of FIG. 4.
Figure 8:
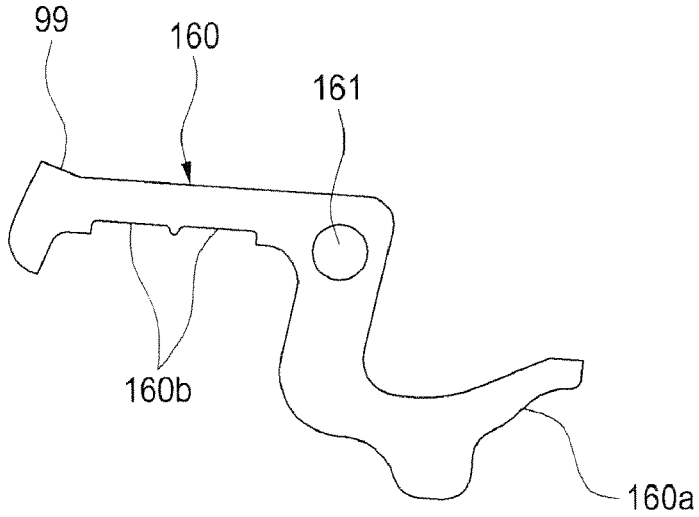
FIG. 8 is a lateral view of a second link according to the exemplary implementation of FIG. 4.
Figure 9:
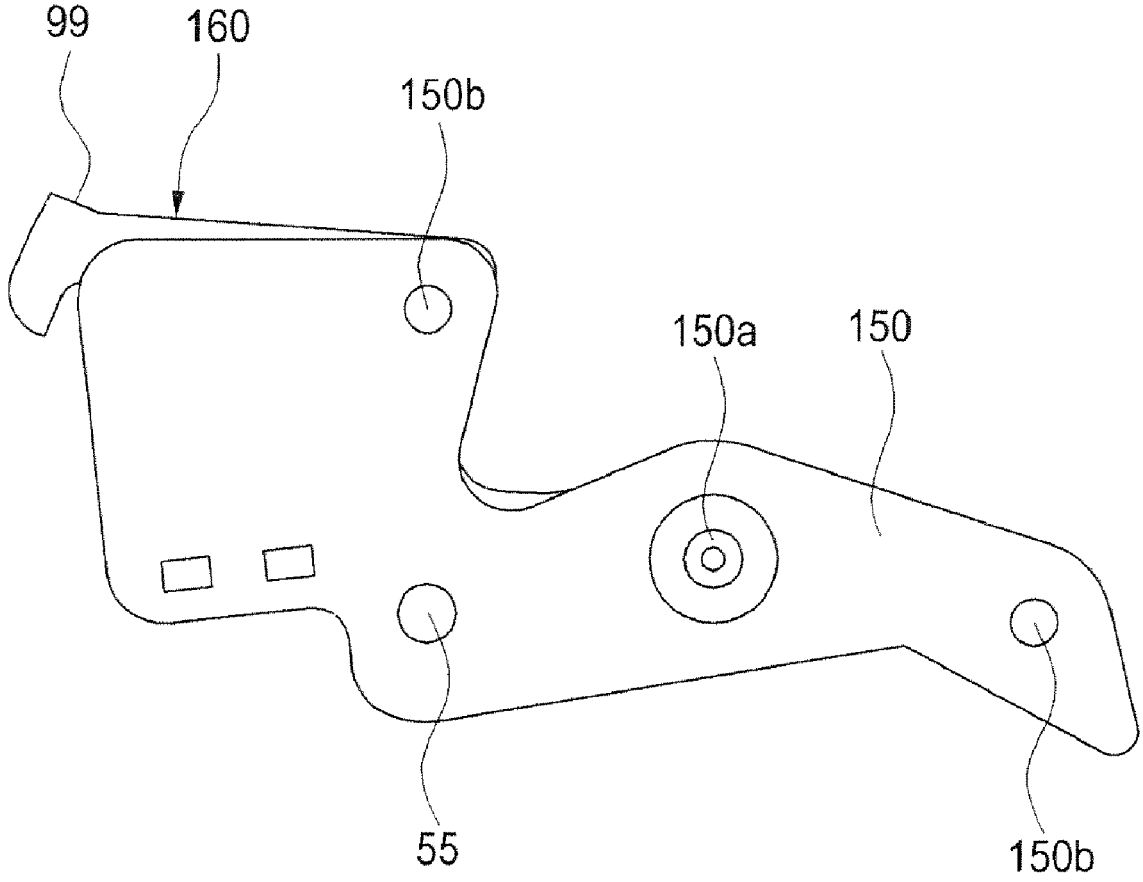
FIG. 9 is a lateral view of an automatic release linkage according to the exemplary implementation of FIG. 4.
Figure 10:
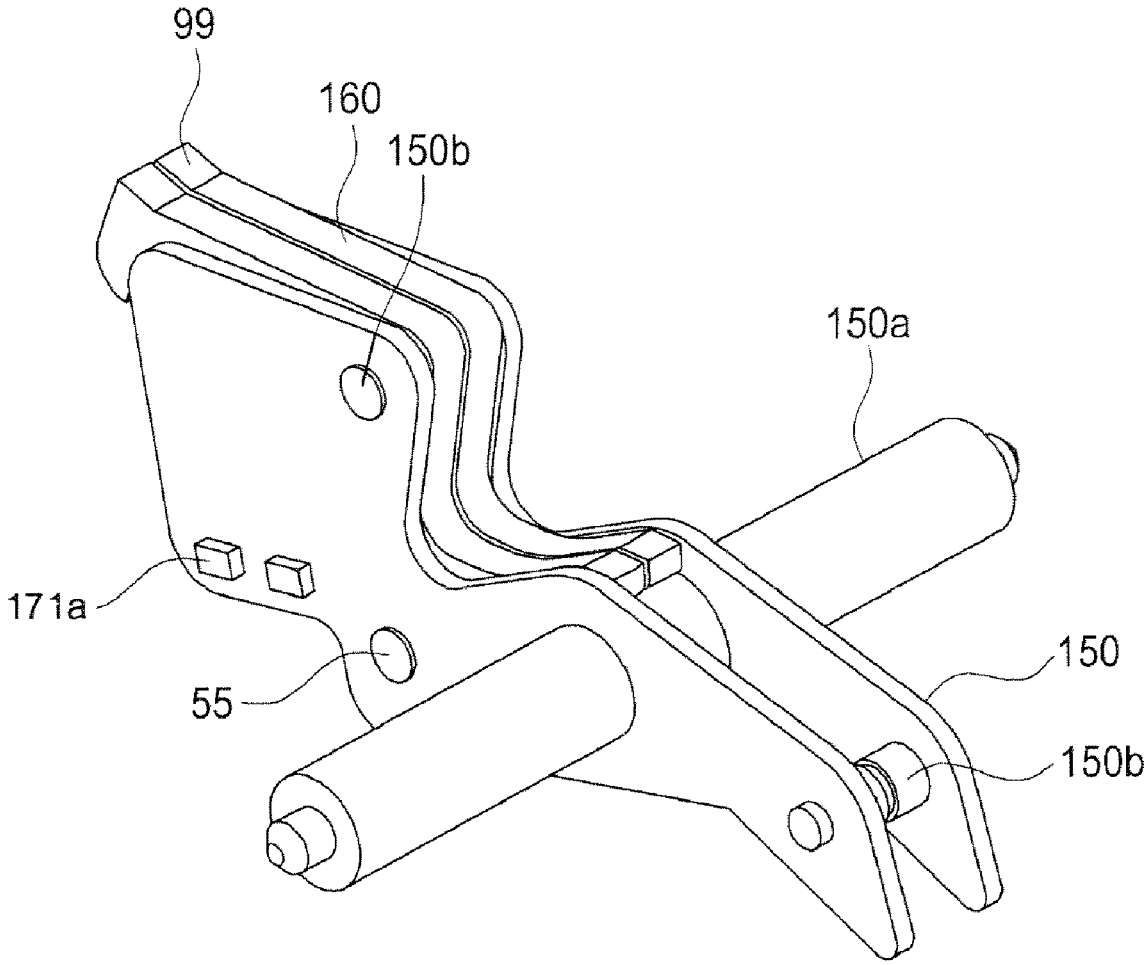
FIG. 10 is a perspective view of an exemplary implementation of FIG. 10.

FIG. 4 is a configurative drawing of principal elements in which a connection state of an open/close linkage and an automatic release linkage in the circuit breaker is shown according to an exemplary implementation, FIG. 5 is a configurative drawing of automatic release operational state according to the exemplary implementation of FIG. 4, FIG. 6 is a configurative drawing of an automatic release operational state having been completed according to the exemplary implementation of FIG. 4, FIG. 7 is a lateral view of a first link according to the exemplary implementation of FIG. 4, FIG. 8 is a lateral view of a second link according to the exemplary implementation of FIG. 4, FIG. 9 is a lateral view of an automatic release linkage according to the exemplary implementation of FIG. 4, and FIG. 10 is a perspective view of an exemplary implementation of FIG. 10.

Referring to FIG. 4, a circuit breaker according to the present invention may include open/close linkages (110, 120, 130, 140, hereinafter referred to as '110-140') applying an operational force (77) to a trip roller (55) in response to receipt of impact force (88) from a movable conduction unit (3), and automatic release linkages (150, 160, 170, hereinafter referred to as '150-170') configured to automatically release the meshed (latched) state with a second link (160) and an open lever (180) when the operational force (77) from the open/close linkages (110-140) is overly activated.

The open/close linkages (110-140) may include an open/close axis (110) rotatably formed toward the direction of reference numeral 110*d* relative to a stationary hinge axis (110*a*) when the impact force (88) from the movable conduction unit (3) is transmitted, a first toggle link (120) mutually and rotatably connected by the open/close axis (110) and a first connection pin (120*a*), a second toggle link (130) mutually and rotatably connected by the first toggle link (120) and a toggle pin (130*a*), and a connection link (140) mutually and rotatably connected by the second toggle link (130) and a second connection pin (130*b*) and rotatably disposed relative to a stationary hinge axis (140*a*).

The open/close linkages (110-140) may apply the operational force (77) to the trip roller (55) contacting a distal cross-sectional surface (140*c*) of the connection link (140) in response to the transmission of the impact force (88) from the movable conduction unit (3).

The automatic release linkages (150-180) may include a first link (150) rotatably formed relative to a latch pin (150*a*) for rotatably fixing the trip roller (55), a second link (160) rotatably coupled to the first link (150) for being arranged at one surface thereof to contact the open lever (180), and a spring (170) compressively mounted at a predetermined level between the spring seat (171) fixed at an inner side of the first link (150) and the second link (160).

Now, referring to FIGS. 7 and 10, the first link (150), to be exact, a pair of first links (150), may be formed at each lateral surface of the second link (160). The first link (150) may be piercingly and centrally formed with an eleventh connection hole (151) for accommodating the latch pin (150*a*). The first link (150) may be piercingly formed with a rotation hole (152) inserted by a pin (not shown) for being rotatably coupled with the second link (160). The first link (150) may be piercingly formed with a through hole (153) inserted by a rotational axis of the trip roller (55) for being rotatably coupled to the trip roller (55). The first link (150) is piercingly formed with a spring seat fixation hole (154) inserted by a lug (171*a*) of the spring seat (171) for fixing the spring seat (171). The first link (150) is so formed with a size that does not interfere with the open lever (180) even if rotated about the latch pin (150*a*).

Referring to FIGS. 8 and 10, the second link (160), to be exact, a pair of second links, may be overlappingly formed at an inner side of the first link (150). The second link (160) may be piercingly formed with a rotation hole (161) inserted by a pin (not shown) for being rotatably coupled with the first link (160). The second link (160) is formed with a spring accommodation unit (160*b*) for stably supporting a distal end of the spring (170). The second link (160) is formed at a distal cross-sectional surface thereof with an upwardly inflected surface (99) that contacts the open lever (180) lest the contact with the open lever (180) should be responsively released by the operational force under a connected state in which current normally flows in the movable conduction unit (3). The other opposite surface (160*a*) of the contact point based on the rotational center (161) while the inflected surface (99) of the second link (160) contacts the open lever (180) is arranged to contact the latch pin (150*a*), whereby the second link (160) is prevented from being rocked by external disturbance or small shock relative to the first link (150).

Referring to FIG. 10, the spring (170) is disposed between the spring seat (171) and the spring accommodation unit (160*b*) of the second link (160) with a predetermined compression force by the lug (171*a*) of the spring seat (171) being inserted into the spring seat fixation hole (154) of the pair of first links (150). In so doing, the second link (160) relative to the first link (150) is acted on with a spring moment (Ms).

MODE FOR INVENTION

Now, the operational principle of the circuit breaker having an automatic release linkage will be described.

FIG. 4 is a configurative drawing of a circuit breaker in which the automatic release linkages (150-170) are assembled at a position of the open latch (22). In other words, an open/close axis (110) is rotated clockwise to cause the movable conduction unit (3) to mutually connect the upper and lower terminal (1, 2) into an electrical conduction state therebetween.

Under the connected condition, when the impact force (88) generated by the movable conduction unit (3) is reacted on the open/close axis (110), the impact force (88) causes the trip roller (55) of the automatic release linkages (150-180) to be affected by the operational force (77) to the direction shown in FIG. 5 via the first and second toggle link (120, 130). The force causes the second link (160) to contact the open lever (180) in response to the elastic restoring force of the spring (170), thereby allowing the toggle links (120, 130) to maintain the toggled and connected state. If the impact force (88, i.e., force generated by short-circuited current of 100 Ka) is a force capable of withstanding the circuit breaker, the open lever (180) must be rotated by a trip button (not shown) and a trip solenoid (not shown), such that trip can be realized as shown in FIG. 3.

However, if the impact force (88) generated by a short-circuited current (i.e., 150 Ka) higher than a predetermined level is acted on the open/close axis (110) under the connected condition, as illustrated in FIG. 4, a trip operation is progressed by the automatic release linkages (150-170) as contact with the open lever (190) is automatically released, which is transmitted to the operation mechanism of the circuit breaker to prevent the damage to the operation devices such as the toggle links (120, 130) or the open latch.

To be more specific, if the operation moment (77*m*) in response to the operational force (77) perpendicularly acting on a contact surface between the trip roller (55) and the connection link (140) is greater than the spring moment (Ms) in response to the spring (17), the first link (150) is rotated toward the operation moment (77*m*) to compress the spring (170). At this time, the inflected surface (99) on one surface of the second link (160) is brought into contact the open lever (180).

A rotation point (150*b*) which is a connection point between the first link (150) and the second link (160) is also rotated (160*m*) by the rotation of the first link (150) about the latch pin (150*a*).

Referring to FIG. 5, if the rotational angle of the first link (150) is great, the contact point with the open lever (180) of the second link (160) slidably moves to a distal end of the second link (160) in response to the movement of the rotation point (150*b*), whereby the contact point of the second link (160) contacted by the open lever (180) is detached from the open lever (180) to maintain the state as illustrated in FIG. 6. The compressed spring (170) is restored to a normal position to restore the second link (160).

Figure 3:
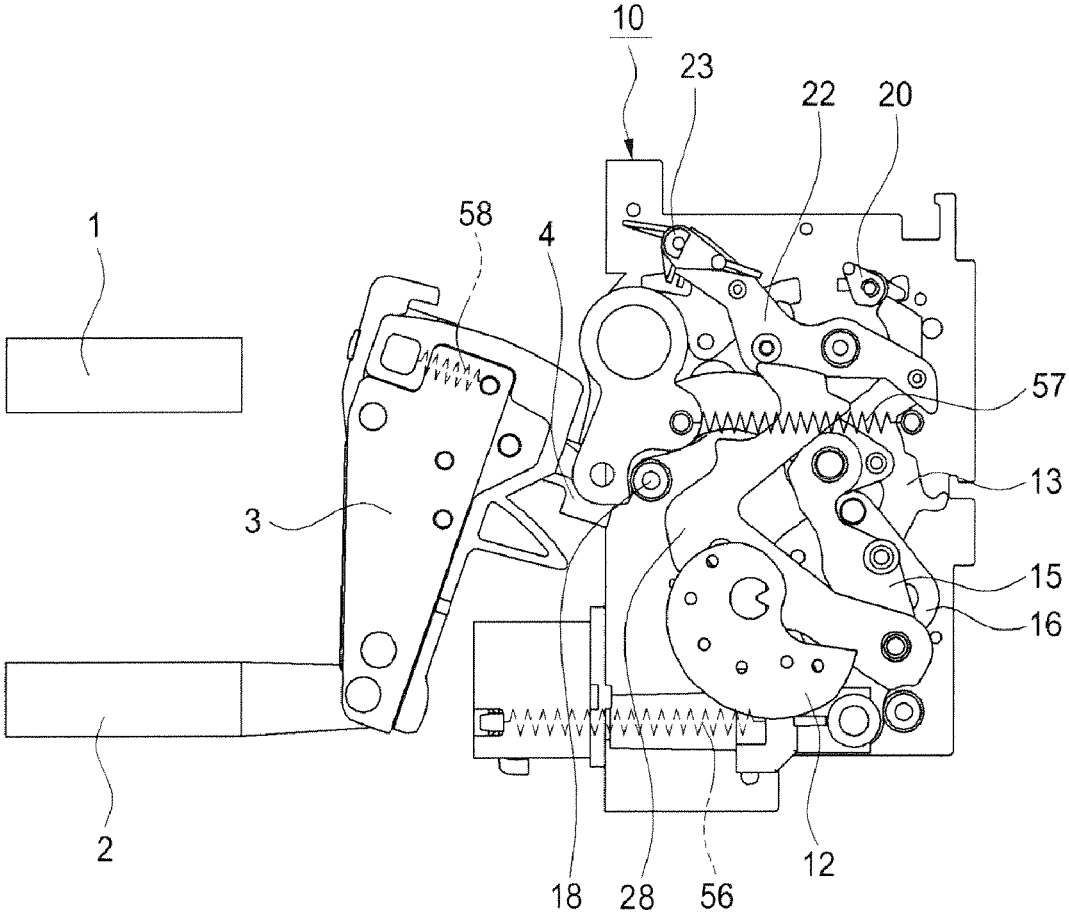
FIG. 3 is a configurative drawing in which an over-current is applied to turn off a contact point according to an exemplary implementation of FIG. 2.

The release of contact state between the second link (160) and the open lever (180) may be accomplished by clockwise rotation of the automatic release linkages (150-170) about the latch pin (150*a*) as shown in FIG. 6, and finally, the open/close axis (110) and the toggle links (120, 130) are rotated to trip the circuit breaker as depicted in FIG. 3.

In other words, if the operation moment (77*m*) in response to the operational force (77) is greater than the spring moment (Ms) in response to the spring (17) set up by the automatic release linkages (150-170), the rotation of the second link (160) relative to the first link (150) and the rotation of the first link (150) relative to the latch pin (150*a*) are simultaneously effected to generate the automatic release.

While the present invention has been particularly shown and described with reference to exemplary implementations thereof, the general inventive concept is not limited to the above-described implementations. It will be understood by those of ordinary skill in the art that various changes in form and details may be made therein without departing from the spirit and scope of the present invention as defined by the following claims.

INDUSTRIAL APPLICABILITY

The circuit breaker having an automatic release linkage is operated in such a fashion that, if an impulsive force from a movable conduction unit reacts greatly by one surface of a second link being closely connected to an open lever and rotatably coupled to a first link, an operational moment in response to an operational force acting from a connection link relative to a trip roller rotatably mounted at the first link is made to act opposite to a spring moment of a spring, whereby a contact state between one surface of the second link and the open lever is slidably released to remove the rotational restraint of the first link, and the restraint between an open/close linkage and the trip roller is automatically released at the same time, effectively preventing the damage to constitutional elements such as an open/close axis of the open/close linkage, a toggle link and a connection link.

The invention claimed is:

1. A circuit breaker having an automatic release linkage including a movable conduction unit for selectively conducting a first terminal and a second terminal by contacting the second terminal while being electrically connected to the first terminal, and an open/close linkage including a connection linkage for transmitting an impact force from the movable conduction unit to a trip roller as an operational force, the circuit breaker comprising:

an open lever;

a first link rotatably fixing the trip roller, rotatably formed about a latch pin and having a size such that the first link does not interfere with the open lever during rotation;

a second link rotatably coupled at the first link to facilitate contact of a lateral cross-sectional surface of the second link with the open lever; and a spring interposed between the first link and the second link for applying an elastic spring force to the first link from the open lever, wherein an operational moment for rotating the first link by an operational force reacts in a direction opposite to that of an elastic spring moment for rotating the first link, such that, when an absolute value of the operational moment is greater than an absolute value of the spring moment, a connection point between the first link and the second link rotates by a rotation of the first link about the latch pin, and the lateral cross-sectional surface of the second link contacting the open lever slips on the open lever to rotate the second link relative to the first link, in order to release a contacted state between the open lever and the second link.

2. The circuit breaker as claimed in claim 1, wherein the lateral cross-sectional surface of the second link connected to the open lever comprises an upwardly inflected surface facing the open lever.

3. The circuit breaker as claimed in claim 1, wherein a rotating center of the second link is located between the latch pin and the open lever.

4. The circuit breaker as claimed in claim 1, wherein a second cross-sectional surface of the second link is connected to the latch pin in order to prevent one side of the second link from rotating toward a direction trying to get near to the open lever, while the lateral cross-sectional surface of the second link contacts the open lever.

5. The circuit breaker as claimed in claim 1, wherein:

the first link comprises a spring seat on an inner side of the first link, the second link comprises a spring accommodation unit on a surface of the second link facing the spring seat, and the spring is interposed between the spring seat and the spring accommodation unit.

* * * * *